United States Patent [19]

Kramming

[11] 4,044,890

[45] Aug. 30, 1977

[54] METHOD OF STORING HANDLE BAGS

[75] Inventor: Erik Kramming, Saltsjobaden, Sweden

[73] Assignee: Bengt Lundin AB, Arvika, Sweden

[21] Appl. No.: 633,880

[22] Filed: Nov. 20, 1975

Related U.S. Application Data

[63] Continuation of Ser. No. 415,854, Nov. 14, 1973, abandoned.

[30] Foreign Application Priority Data

Nov. 24, 1972 Sweden ..... 7215339

[51] Int. Cl.[2] ..... B65D 73/00

[52] U.S. Cl. ..... 206/493; 206/806; 221/312 A; 229/54 R

[58] Field of Search ..... 206/493, 495, 806; 211/49 R, 49 D, 50, 312 R, 312 A, 312 B, 312 C, 45; 229/54 R; 221/312 R, 312 A, 312 B, 312 C, 45

[56] References Cited

U.S. PATENT DOCUMENTS

| | | | |
|---|---|---|---|
| 2,037,770 | 4/1936 | Driver | 206/806 |
| 2,080,092 | 5/1937 | Philippi | 206/493 |
| 3,380,579 | 4/1968 | Pinto | 206/493 |
| 3,881,601 | 5/1975 | Walus et al. | 206/806 |

FOREIGN PATENT DOCUMENTS

| | | | |
|---|---|---|---|
| 100,277 | 5/1962 | Norway | 206/806 |

*Primary Examiner*—William Price
*Assistant Examiner*—Joseph Man-Fu Moy
*Attorney, Agent, or Firm*—Fred Philpitt

[57] ABSTRACT

A method for supporting a bundle of two-handle bags so as to better insure that only one bag at a time will be removed.

5 Claims, 2 Drawing Figures

METHOD OF STORING HANDLE BAGS

This is a continuation of application Ser. No. 415,854, filed Nov. 14, 1973, now abandoned.

This invention relates to a method of arranging bundles of bags with two handle openings for removing one bag at a time from the bundle.

In bags with handle openings, and particularly with plastic bags, it has long been a problem to take from a bundle of bags only one bag at a time and to open the bag. It is not possible either to simply stack plastic bags, because the bags will slide or flow after a certain time, unless the stack or bundle is held together. This problem is specially evident at cash registers in self-service shops where the customers are expected to take one bag at a time from a stock and to fill the bag with articles. It was found that the customers in many cases take more bags than necessary and thereby cause economic waste.

The present invention has as its object to eliminate the aforesaid problems and, in addition, provide the possibility of easier filling the bags with articles.

Figure 1:
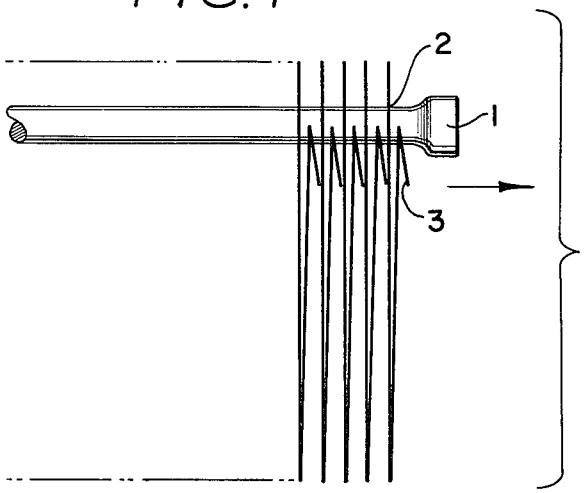
Figure 2:
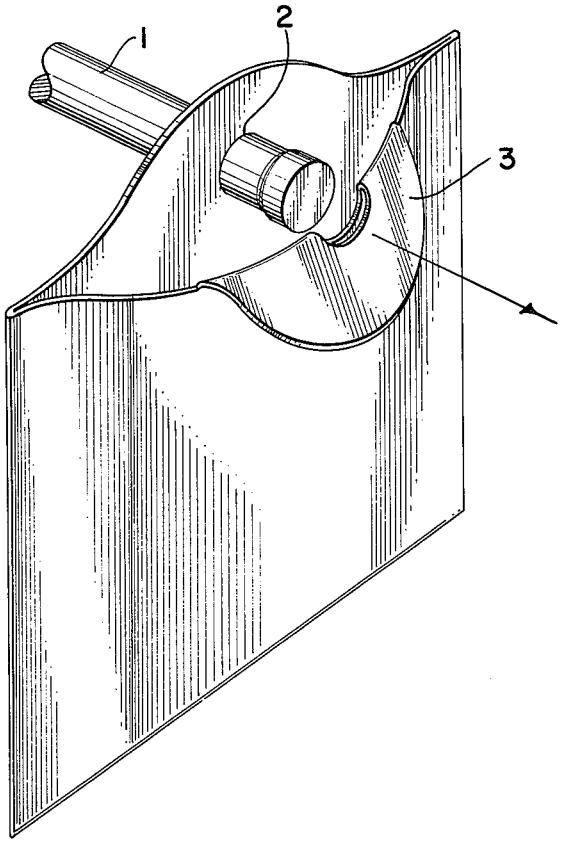

The invention is described in greater detail hereinafter, with reference to the accompanying drawing, in which FIG. 1 shows a side view of the invention with the bags disposed on an elongated support member, and FIG. 2 shows a perspective view of a bag which has been moved to the end of its elongated supporting member and is in a partially opened condition.

According to FIG. 1, the bags are suspended on a rod 1 in such a manner that one of the first of the two handle openings 2 is fitted over the rod. The second of the two handle openings 3 is folded down so as to be located below the rod 1. Said rod 1 has a dimension, which substantially corresponds to the size of the handle opening, and at the end of the rod 1 a thickening may be provided so when the bag is drawn off there is some resistance from the rod 1.

The bags, thus, are in bundles fitted on the rod 1, and the second of the two handle openings 3, which is folded downwards, faces in the direction, in which the bags are drawn off from the rod 1. Due to the fact that the handle opening 3 is folded down, it is easy to seize said handle opening with one hand and draw off the bag from the rod. There is no risk of subsequent bags following along therewith, and the bags, can thus taken from the rod 1 one at a time. When a suitable inertia or friction engagement exists between the rod 1 and the first opening 2, the bag will open itself whilst it is being drawn off the supporting rod and thereby will render it possible to place articles into the open bag. This is facilitated as the bag is seized only with one hand, and the other hand is free for placing articles into the bag.

In the embodiment shown, the bags are arranged freely suspended from a horizontal rod 1, but variations are imaginable and suitable. The rod 1 may be arranged inclined, and lateral supports for the bags may be provided to prevent the bags from swinging forth and back on the rod 1. Furthermore, a bottom support for the bag may be provided in the form of a plate or the like, which plate may extend past the end of rod 1 and constitute a plane for placing the bag thereon after it has been filled or for filling it with articles.

The drawings also show a special embodiment of the bag in which the handle openings are disposed above the bag edges. This is not necessary, but the only necessary requirement is that one handle opening can be folded down. A great number of variations of such bags exist. A possible variation is that the bag is a conventional paper bag with two handles arranged at the upper edge of the bag. Also such a bag can suitably be used for realizing the invention. The rod 1, furthermore, in the embodiment shown is round, but several other shapes may be used. It is essential, however, that a certain agreement exists between the cross-sectional shape of the rod 1 and the handle openings, in order to achieve all of the aforementioned advantages of the invention. It should be emphasized, however, that the rod, for example, may have the form of a board placed on edge and having a longest dimension in the cross-sectional shape which coincides with the dimension of the handle opening in the corresponding direction.

What I claim is:

1. A bag supporting and dispensing arrangement comprising in combination:

a. a bundle of bags, each bag having only two handle openings consisting of a first handle opening located on one side of the bag and a second handle opening located on the opposite side of the bag, the first handle opening of each bag being aligned with the first handle opening of every other bag in the bundle, the second handle opening of each bag being disposed so that it is out of circumferential alignment with said aligned first handle openings, and b. an elongated supporting member for slideably supporting said bundle of bags, said elongated supporting member passing through all of the said aligned first handle openings of each bag in the bundle, the discharge end of said supporting member being shaped to inhibit but not prohibit the removal of each first handle opening therefrom, the second handle opening of each bag being closer to the discharge end of the supporting member than the first handle opening of said same bag.

2. A bag supporting and dispensing arrangement comprising in combination:

a. an elongated supporting member having a discharge end that has an enlarged dimension compared to the rest of the supporting member, and b. a bundle of plastic bags, each bag having only two handle openings consisting of a first handle opening located on one side of the bag and a second handle opening located on the opposite side of the bag, the first handle opening of each bag being dimensioned so that it will encounter significant resistance with the discharge end of said elongated supporting member, whereby said first handle opening can only be moved past the discharge end of said elongated supporting member by overcoming said significant resistance, the second handle opening of each bag being always disposed closer to the discharge end of the supporting member than the first handle opening of the same bag and each second handle opening being positioned in relation to said elongated tubular supporting member so that it can be moved past said discharge end.

3. A bag and dispensing arrangement comprising in combination:

an elongated supporting member, a bundle of plastic bags supported by said supporting member, each bag having only two handle openings consisting of a first opening located on one side of the bag and a second handle opening located on the opposite side of the bag, the discharge end of said elongated supporting member and the first handle opening of each bag being constructed and dimensioned relative to each other so that when the bag is pulled in a direction parallel to the axis of the supporting member the discharge end of the elongated supporting member will offer significant resistance to the removal of the bag, the second handle opening of each bag being always disposed closer to the discharge end of the supporting member than the first handle opening of the same bag and each second handle opening being arranged in relation to said elongated tubular supporting member so that it can be moved past said enlarged discharge end without overcoming any significant resistance between said second handle opening and the discharge end of the elongated supporting member.

4. A bag supporting and dispensing arrangement comprising in combination:

a. a bundle of plastic bags, each bag having a first handle opening located on one side of the bag and a second handle opening located on the opposite side of the bag, the first handle opening of each bag being upright and aligned with the first handle opening of every other bag in the bundle, the second handle opening of each bag being folded so that it is out of alignment with said aligned first handle openings, and b. an elongated supporting member for slideably supporting said bundle of bags, said elongated supporting member passing through all of the said aligned first handle openings of each bag in the bundle, the discharge end of said supporting member having a maximum dimension that is slightly larger than the maximum dimension of said first handle opening so that said first handle opening can only be pulled over said discharge end of said elongated supporting member by a stretching of said first handle opening, the second handle opening of each bag being closer to the discharge end of the supporting member than the first handle opening of said same bag.

5. A bag supporting and dispensing arrangement comprising in combination:

a. a bundle of plastic bags, each bag having a first handle opening located on one side of the bag and a second handle opening located on the opposite side of the bag, the first handle opening of each bag being upright and aligned with the first handle opening of every other bag in the bundle, the second handle opening of each bag being folded so that it is out of alignment with said aligned first handle openings, and b. an elongated supporting member for slideably supporting said bundle of bags, said elongated supporting member passing through all of the said aligned first handle openings of each bag in the bundle, the discharge end of said supporting member being shaped to inhibit but not prohibit the removal of each first handle opening therefrom, the second handle opening of each bag being closer to the discharge end of the supporting member than the first handle opening of said same bag.

* * * * *